United States Patent [19]

Locke

[11] 4,236,714

[45] Dec. 2, 1980

[54] GAME APPARATUS

[76] Inventor: Carl L. Locke, 2413 W. 6th St., Irving, Tex. 75060

[21] Appl. No.: 7,553

[22] Filed: Jan. 29, 1979

[51] Int. Cl.[3] ..... A63F 7/06

[52] U.S. Cl. ..... 273/94 R; 273/1 E

[58] Field of Search ..... 273/1 R, 1 E, 1 M, 237, 273/94 R

[56] References Cited

U.S. PATENT DOCUMENTS

| | | | |
|---|---|---|---|
| 2,808,263 | 10/1957 | Goldfinger et al. | 273/1 E |
| 2,874,966 | 2/1959 | Kerwin | 273/94 R X |
| 3,181,865 | 5/1965 | Tout | 35/66 X |
| 3,895,799 | 7/1975 | Rinne | 273/94 R X |

*Primary Examiner*—George J. Marlo

*Attorney, Agent, or Firm*—W. Thomas Timmons

[57] ABSTRACT

A game apparatus for play between two opposing teams and including a game board with a cover simulating a playing field, with one goal at each end of the simulated playing field is disclosed. The game board is electrically conducting, and the cover which forms openings over the playing area is electrically insulating. The game apparatus also includes a movable playing piece having an electrically conducting base suitable for making contact with the game board through the openings formed in the cover. The electrically conducting base includes a spring coiled around a marker and extending beyond the tip of the marker when uncompressed. The electrically conducting base is electrically connected to a power supply and an electrically operable alarm device so that the alarm device is operated when the base of the playing piece touches the game board, but not when the base touches the cover without touching the game board. A chance number selector is included for determining an initial position of the playing piece on the simulated playing field. In one arrangement, a blindfold is included for covering the eyes of the player moving the playing piece, and a marker suitable for marking on the cover is associated with the playing piece so that the route followed by the playing piece is marked on the cover. In one arrangement, the cover is detachably removable from the game board so that different covers having different hole patterns representing various degrees of skill can be readily substituted.

9 Claims, 5 Drawing Figures

GAME APPARATUS

BACKGROUND OF THE INVENTION

1. Field of the Invention:

The present invention relates generally to board games, and in one of its aspects, to a board game which simulates a field game such as football or soccer.

2. Description of the Prior Art

Numerous games have been provided to simulate various field games such as football and soccer. A large number of these games are merely games of chance in which skill and strategy play a minor role. Others are elaborate games of strategy involving numerous charts and cards making the games too complex for casual or very young players. Most such games approximate some part of the actual field game simulated.

SUMMARY OF THE INVENTION

A primary object of this invention is to provide a game which can be played by casual and young participants.

Another object of this invention is to provide a game in which the outcome is dependent upon both chance and the skill of the participants.

Another object of the present invention is to provide a competitive game with audible or visual response to the actions of the players.

Yet another object of this invention is to provide a game which simulates some of the broken-field behavior of players in the real games which are simulated.

A game apparatus according to the present invention includes an electrically conducting game board, an electrically insulating cover suitable for covering the playing area of the game board, an electrically operable alarm device and at least one movable playing piece having an electrically conducting base. The cover forms a plurality of openings over the playing area when it is in place, and the base of the playing piece is suitable for making electrical contact with the game board through the openings formed in the cover. The game apparatus is to be used with an electrical power supply for driving the alarm device, and the base of the playing piece, the game board, and the alarm device are electrically connected to operate the alarm device when the base of the playing piece touches the game board and to not operate the alarm device when the base of the playing piece touches the cover without touching the game board.

A preferred form of the game apparatus is for play between two opposing teams of at least one player each. The game board with the cover in place simulates a rectangular playing field with one goal at each end. One object of the game is for one team to move a playing piece from the playing field to beyond one goal while maintaining continual contact between the base of the playing piece and the cover without making electrical contact between the base of the playing piece and the game board. The game apparatus of this arrangement also includes a chance number selector for determining an initial position of the playing piece on the simulated playing field. A preferred arrangement of the game apparatus includes a blindfold for covering the eyes of the player moving the playing piece, and a marker suitable for marking on the cover associated with the at least one playing piece so that the route followed by the playing piece while it is on the cover is marked on the cover.

A preferred form of the alarm device includes an audible alarm so that the blindfolded player will know when he has made electrical contact with the game board through one of the holes in the cover.

A preferred form of the cover is made of a thin material so that the slight hand pressure used to make the playing piece stay in contact with the cover will be enough to make electrical contact with the board if the playing piece goes over the edge of one of the holes. A preferred form of the cover is a detachable transparent sheet. Using such a cover, the playing field is simulated on the game board itself, and does not need to be simulated on every cover. By making the covers detechable, covers representing different skill levels can be easily substituted. Further, if the detachable covers are of an inexpensive material, each can simply be thrown away when it is too marked up to continue in use.

These and other objects, advantages and features of this invention will be apparent from the following description taken with reference to the accompanying drawings, wherein is shown the preferred embodiments of the invention.

DETAILED DESCRIPTION

Figure 1:
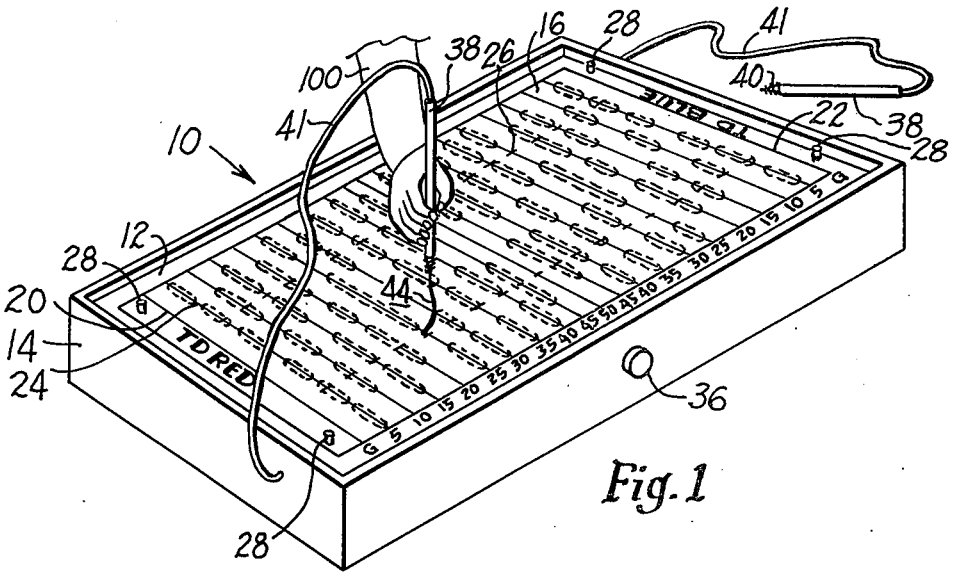
FIG. 1 is a perspective view of a game apparatus in accordance with the present invention being used by a player.

Referring now to the drawings, in FIG. 1 a game apparatus according to the present invention is referred to generally by reference numeral 10. Game apparatus 10 includes an electrically conducting game board 12 supported by an electrically insulating frame 14. An electrically insulating cover 16 substantially covers the playing area of game board 12. Cover 16 forms a plurality of openings 18 which are over the playing area when cover 16 is in place. Game board 12 with cover 16 in place simulates a playing field, in this case a football field with a goal line 20 for red and a goal line 22 for blue, and other yard lines 24 marked at even intervals along the length of the board. Hash marks 26 divide the width of the playing area roughly into thirds.

Figure 2:
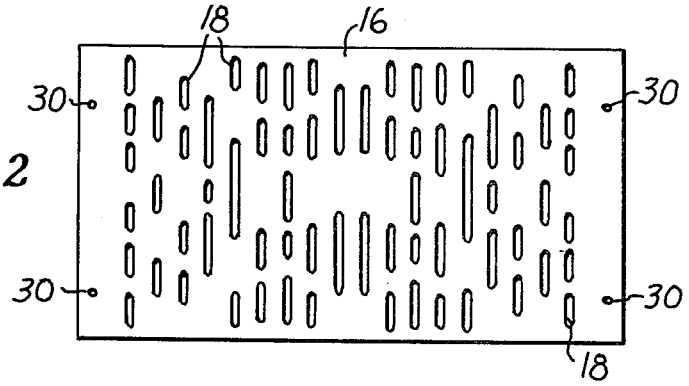
FIG. 2 is a plan view of a cover for a game apparatus in accordance with the present invention.

Referring also to FIG. 2, a preferred form of cover 16 is a detachable transparent sheet so that the playing field is simulated on the game board itself. Plurality of openings 18 forms a symetrical pattern about both the longitudinal and lateral center lines for equally matched players. Game apparatus 10 includes pegs 28 affixed to game board 12 outside of the playing area, and extending upwardly. Cover 16 forms peg holes 30 for fitting over pegs 28. Cover 16 is held in place by pegs 28, but is easily removed for cleaning or exchanging with another cover forming a different pattern of plurality of openings 18.

Figure 3:
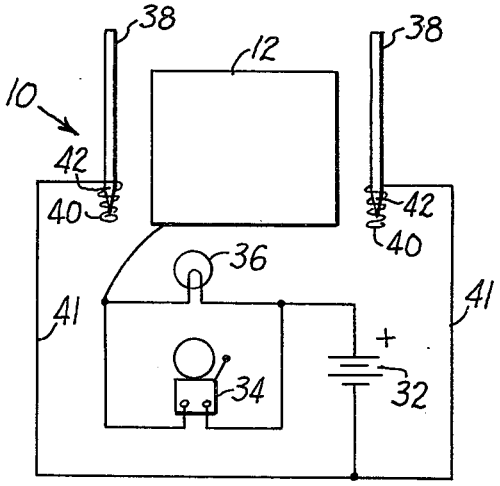
FIG. 3 is an electrical schematic of a game apparatus in accordance with the present invention.

Referring to FIGS. 1 and 3, game apparatus 10 is to be used with an electrical power supply 32, and inludes an electrically operable alarm device comprising an audible alarm 34 and a light 36, driven by electrical power supply 32. Game apparatus 10 further includes at least one movable playing piece 38 having an electrically conducting base 40 suitable for making electrical contact with game board 12 through openings 18 formed in cover 16. Base 40, game board 12, and the alarm device made up of audible alarm 34 and light 36 are electrically connected by wires 41 to operate the alarm device when base 40 of playing piece 38 makes electrical contact with game board 12, and to not operate the alarm device when base 40 of playing piece 38 touches cover 16 without making electrical contact with game board 12. For added interest, playing piece 38 can be made in the shape of a football or a football player.

A marker 42 suitable for marking on cover 16 is associated with playing piece 38. The route 44 followed by playing piece 38 while it is on cover 16 is marked on the cover. A different color of marker 42 can easily be used for each team where there is a separate playing piece 38 for each team. A preferred form of electrically conducting base 40 is a spring coiled around marker 42 and extending beyond the tip of the marker. A player 100 must press the spring down sufficiently for the marker to touch cover 16 in order to mark route 44. The slight compression of the spring of base 40 required to mark route 44 of playing piece 38 is sufficient to immediately expand the spring and make electrical contact with game board 12 once the edge of an opening 18 has been crossed by the spring base 40, so that it is not possible for player 100 to avoid getting caught by simply carefully moving his hand in a horizontal direction and not exerting enough downward pressure to make electrical contact with game board 12.

Figure 4:
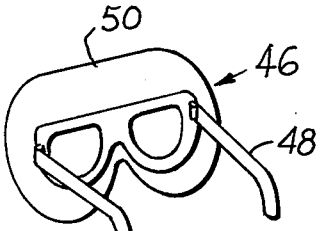
FIG. 4 is a blindfold for use with a game apparatus in accordance with the present invention.

Referring now to FIG. 4, game apparatus 10 further includes a blindfold 46 for covering the eyes of player 100 while moving playing piece 38. Blindfold 46 in this case is a frame 48 for glasses covered by a piece of paper 50 to prevent sight through or around frame 48. Blindfold 46 is thus easily placed over the eyes of player 100 and easily removed. A simple cloth handkerchief or other blindfold could also be used.

Figure 5:
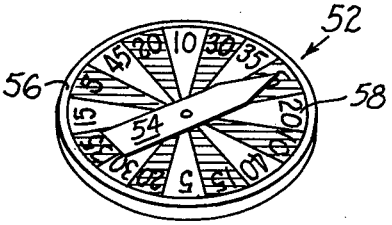
FIG. 5 is a chance number selector in accordance with the present invention.

Referring to FIG. 5, game apparatus 10 further includes a chance number selector 52 which in this case includes a spinner 54 and a numer wheel 56. Number wheel 56 is divided into alternate blue and red slices 58, where the lining in FIG. 5 represents color only. Slices 58 each contain a number representing a certain position on game board 12. Chance number selector 52 can thus be used for determining an initial position of playing piece 38 on the simulated playing field as well as for other purposes which will be apparent from the rules of the game.

A preferred form of play for the game apparatus of the present invention is for play between two opposing teams of at least one player 100 each wherein game board 12 with cover 16 in place simulates a rectangular playing field with two goals 20 and 22, one goal at each end of the simulated playing field. One object of the game is for one team to move its playing piece 38 from the playing field to beyond one of the goals while maintaining continual contact between base 40 of playing piece 38 and cover 16 without making electrical contact between base 40 of playing piece 38 and game board 12.

General Rules:

1. Two teams of at least one player each—each team chooses a color, one red and one blue.

2. Set a time limit, for example thirty minutes or one hour, or set a predetermined number of equal possessions.

3. Player 100 spins spinner 54. Team with the same color as slice 58 pointed to by spinner 54 has the option of first possession or end of field.

4. First possession player now spins spinner 54 to determine initial position on the playing field. Disregard the colors of slices 58 on this spin, the number on the slice determining the placement of playing piece 38 on first player's end of the playing field. Example: first player spins a 35. First player begins between the hash marks 26 and behind his own 35 yard line. First player puts his playing piece 38 in position behind the 35 yard line, plants a mental image in his mind of route 44 he wishes to take, and now places blindfold 48 over his eyes and proceeds to follow the route for his first play.

5. First player has only four downs to score. There are no first downs and no penalties.

6. When first player's first play ends by running into one of the trap tackles represented by openings 18 or by going out of bounds, he brings his playing piece back between the hash marks and behind the yard line at which he was stopped. He now gets to look at the board again to set another mental route, puts on the blindfold again and proceeds with his second down. The third down and fourth down are similar.

7. If first player fails to score in four downs, the opposing team takes possession where he left off. The second player then has four downs to score.

8. If a player scores, his team gets six points, and may try to convert the extra point for one point by spinning spinner 54. Red team gets an extra point by spinning to a red slice, and blue team gets an extra point by spinning to a blue slice. A team may try for two points rather than taking the extra point by placing the playing piece between the hash marks and beyond the 20 yard line from the goal. The team is allowed one play to cross the goal for the two-point conversion.

9. Once one team has scored, the opposing team spins spinner 54 to find its starting position for the next play.

10. If a team has possession of the ball within its opponent's 35 yard line with at least one down of play remaining, it may choose to spin for a three-point field goal. Example: red team spins and hits red, conversion is good. If red player fails to spin his own color, his opponent takes possession on his own 35 yard line, regardless of where the field goal attempt was made.

11. Safeties: if a player happens to run playing piece 38 into his own end zone, his opponent gets two points and possession of play to begin where he spins just as if it were a kickoff spin.

12. End of game: total number of points determines the winner.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A game apparatus to be used with an electrical power supply, comprising in combination:

an electrically conducting game board;

an electrically insulating cover suitable for substantially covering the playing area of the game board, the cover forming a plurality of openings over the playing area when in place, wherein the game board with the cover in place simulates a playing field;

an electrically operable alarm device driven by the electrical power supply;

at least one movable playing piece having an electrically conducting base suitable for making electrical contact with the game board through the openings formed in the cover wherein the base of the at least one playing piece, the game board, and the alarm device are electrically connected to operate the alarm device when the base of the at least one playing piece makes electrical contact with the game board, and to not operate the alarm device when base of the at least one playing piece touches the cover without making electrical contact with the game board; and a marker suitable for marking on the cover associated with the at least one playing piece wherein the route followed by the playing piece while it is on the cover is marked on the cover, wherein the electrically conducting base of the playing piece comprises a spring coiled around the marker and extending beyond the tip of the marker whereby the spring must be compressed in order for the marker to mark on the cover.

2. A game apparatus according to claim 1 for play between two opposing teams of at least one player each wherein the game board with the cover in place simulates a rectangular playing field with two goals, one goal at each end of the simulated playing field, and one object of the game is for one team to move a a playing piece from the playing field to beyond one goal while maintaining continual contact between the base of the playing piece and the cover without making electrical contact between the base of the playing piece and the game board, the game apparatus further comprising a chance number selector for determining an initial position of the playing piece on the simulated playing field.

3. A game apparatus according to claim 2 further comprising in combination:

a blindfold for covering the eyes of the player moving the playing piece; and a marker suitable for marking on the cover associated with the at least one playing piece wherein the route followed by the playing piece while it is on the cover is marked on the cover.

4. A game apparatus according to claim 3 wherein the alarm device comprises an audible alarm and a light, and the cover comprises a detachable transparent sheet whereby the playing field is simulated on the game board.

5. A game apparatus according to claim 1 further comprising in combination:

a blindfold for covering the eyes of the player moving the playing piece.

6. A game apparatus according to claim 5 wherein the alarm device comprises an audible alarm and a light, and the cover comprises a detachable transparent sheet whereby the playing field is simulated on the game board.

7. A game apparatus according to claim 1 wherein the alarm device comprises an audible alarm and a light, and the cover comprises a detachable transparent sheet whereby the playing field is simulated on the game board.

8. A game apparatus according to claim 7 for play between two opposing teams of at least one player each wherein the game board with the cover in place simulates a rectangular playing field with two goals, one goal at each end of the simulated playing field, and one object of the game is for one team to move a playing piece from the playing field to beyond one goal while maintaining continual contact between the base of the playing piece and the cover without making electrical contact between the base of the playing piece and the game board, the game apparatus further comprising a chance number selector for determining an initial position of the playing piece on the simulated playing field.

9. A game apparatus for play between at least two opposing teams of at least one player each, comprising in combination:

a game board;

a cover suitable for substantially covering the playing area of the game board, the cover forming a plurality of openings over the playing area when in place, wherein the game board with the cover in place simulates a playing field with two goals, one goal at each end of the simulated playing field;

at least one playing piece suitable for making contact with the game board through the openings formed in the cover wherein one object of the game is for one team to move a playing piece from the playing field to beyond one goal while maintaining continual contact between the playing piece and the cover without making contact between the playing piece and the game board; and a marker suitable for marking on the cover associated with the at least one playing piece wherein the route followed by the playing piece while it is on the cover is marked on the cover, wherein the playing piece comprises a spring coiled around the marker and extending beyond the tip of the marker whereby the spring must be compressed in order for the marker to mark on the cover.

* * * * *